US005487364A

United States Patent [19]

Takeda et al.

[11] Patent Number: 5,487,364

[45] Date of Patent: Jan. 30, 1996

[54] PISTON FOR AN INTERNAL COMBUSTION ENGINE

[75] Inventors: Masashi Takeda; Kazuyuki Fukuhara, both of Toyota; Motoichi Murakami, Susono, all of Japan

[73] Assignee: Toyota Jidosha Kabushiki Kaisha, Toyota, Japan

[21] Appl. No.: 216,981

[22] Filed: Mar. 23, 1994

[30] Foreign Application Priority Data

Jun. 10, 1993 [JP] Japan ..... 5-138244

[51] Int. Cl.[6] ..... F02F 3/00

[52] U.S. Cl. ..... 123/193.6

[58] Field of Search ..... 123/193.6, 668, 123/669; 92/208, 237

[56] References Cited

U.S. PATENT DOCUMENTS

| | | | |
|---|---|---|---|
| 2,802,707 | 8/1957 | Day | 92/237 |
| 3,319,535 | 5/1967 | Holcombe | 92/208 |
| 4,648,309 | 3/1987 | Schellmann | 123/193.6 |
| 4,856,417 | 8/1989 | Ishikawa | 123/193.6 |
| 5,076,225 | 12/1991 | Tokoro et al. | 123/193.6 |
| 5,257,603 | 11/1993 | Bauer et al. | 123/193.6 |

FOREIGN PATENT DOCUMENTS

| | | |
|---|---|---|
| 61-58954 | 3/1986 | Japan . |
| 3-115762 | 5/1991 | Japan . |
| 3-164556 | 7/1991 | Japan . |
| 3-194196 | 8/1991 | Japan . |

*Primary Examiner*—Marguerite Macy
*Attorney, Agent, or Firm*—Kenyon & Kenyon

[57] ABSTRACT

A piston for an internal combustion engine includes a skirt portion configured so that a value S/(D * L) is in the range of 0.4–0.55, where L is a length of the skirt portion, D is a diameter of a cylinder bore, and S is an area of an image of the skirt portion when the skirt portion is projected onto a plane perpendicular to a direction connecting a pair of boss portions. This condition decreases the friction between the piston and the cylinder bore.

10 Claims, 2 Drawing Sheets

PISTON FOR AN INTERNAL COMBUSTION ENGINE

BACKGROUND OF THE INVENTION

1. Field of the Invention

The present invention relates to a piston for an internal combustion engine.

2. Description of the Prior Art

Various structures for lightening a piston and decreasing friction between a piston and a cylinder bore have been proposed to thereby improve the fuel economy and power of the engine. For example, Japanese Patent Publication SHO 61-58954 proposes a piston wherein a ratio of an axial length of a piston skirt to a cylinder bore diameter is selected within the range of 0.15–0.25 to thereby conspicuously shorten the skirt length, to lighten the piston and to decrease the piston friction.

However, the prior art piston suffers from the following problems.

First, selection of the skirt length only will not necessarily decrease the friction between the piston and the cylinder bore, because the piston friction depends on the skirt bearing pressure (namely, the thrust/counter-thrust force/the skirt surface area), which in turn depends not only on the skirt length but also depends on the skirt width.

Second, if the ratio of the skirt length to the bore diameter is set in the above-described range, the lower end of the skirt will come to a position above the lowermost portion of the piston-pin hole. This makes the piston attitude unstable in the thrust/counter-thrust direction.

Therefore, the above-described structure is not necessarily optimal from the viewpoints of piston friction and piston attitude.

SUMMARY OF THE INVENTION

An object of the present invention is to provide a piston for an internal combustion engine which can minimize the friction between a piston and a cylinder bore, maintain a stable piston attitude, and lighten the piston.

To achieve the object, in a piston for an internal combustion engine in accordance with the present invention, the following dimensional relationship holds:

$$0.4 \leqq S/(D * L) \leqq 0.55$$

where, L is a length of the skirt portion,

D is a diameter of a cylinder bore, and

S is a projected area of the skirt portion.

According to the above-described relationship, the piston friction is decreased as discussed below. More particularly, the piston slidably contacts with the cylinder bore at the skirt portion. It is presumed that the factor determining the friction between the piston and the cylinder bore is not the height of the skirt portion but the projected area of the skirt portion. To see the effect of the projected area of the skirt portion on the piston friction, tests in which the projected areas of the skirt portions were varied were conducted. In the tests, to see the results independently of variances in piston size, the instant projected areas S of the skirt portions were divided by the projected areas, D * L of the corresponding full skirts (namely, the skirts extending over the entire circumferences), to be expressed in the form of non-dimension. From the test results, it was seen that when the value S/(D * L) was in the range of 0.4–0.55, the piston friction was small. This is the reason why the above-described relationship is set to the dimensions, S, D, and L according to the present invention. For a piston having this determined relationship, the piston friction is optimally decreased.

In contrast, the value, S/(D * L) of the conventional piston is usually about 0.6. Therefore, the skirt portion of the piston according to the present invention is smaller than that of the conventional piston, and the piston according to the present invention is lightened and improves in fuel economy as compared to the conventional piston.

BRIEF DESCRIPTION OF THE DRAWINGS

The above and other objects, features, and advantages of the present invention will become more apparent and will be more readily appreciated from the following detailed description of the preferred embodiments of the invention taken in conjunction with the accompanying drawings, in which.

DETAILED DESCRIPTION OF THE PREFERRED EMBODIMENTS

Figure 1:
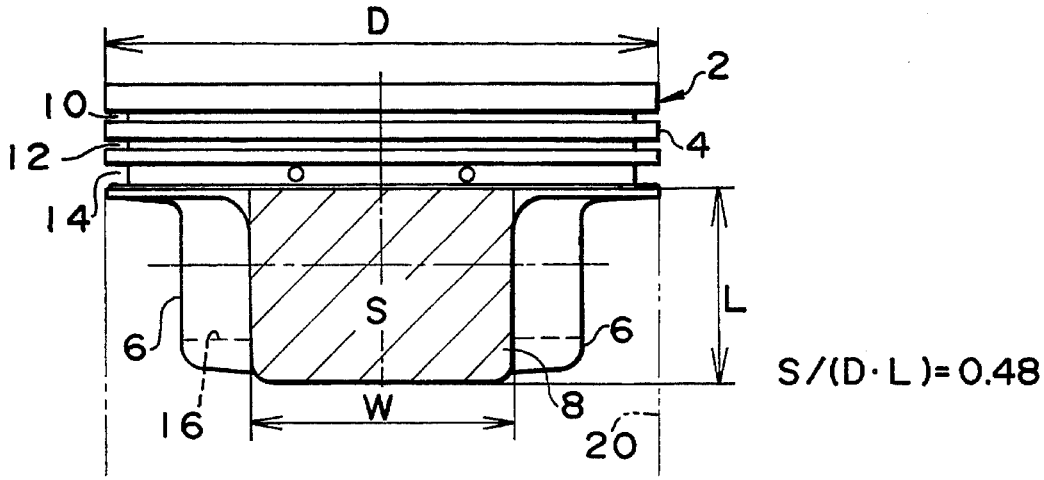
FIG. 1 is an elevational view of a piston for an internal combustion engine in accordance with a first embodiment of the invention.

FIGS. 1–4 illustrate the embodiments of the invention. FIGS. 1, 2, 3, and 4 correspond to the first, second, third, and fourth embodiments of the invention, respectively. FIG. 5 illustrates the friction test results. Throughout all the embodiments of the invention, portions having the same or similar structures are denoted with the same reference numerals.

First, structures common to all the embodiments of the invention will be explained with reference to, for example, FIG. 1. As illustrated in FIG. 1, a piston 2 for an internal combustion engine in accordance with the invention includes a top portion 4 configured to be substantially circular, a pair of boss portions 6 integrally connected to the top portion 4 from a lower side of the top portion 4, and a pair of skirt portions 8 integrally connected to the top portion 4 from the lower side of the top portion 4. The top portion 4, the boss portions 6, and the skirt portions 8 define a monolithic piston body preferably constructed of an aluminum alloy. In the top portion 4, piston ring grooves 10 and 12 and an oil ring groove 14 are formed. Piston rings (not shown) are fitted in the piston ring grooves 10 and 12 and an oil ring (not shown) is fitted in the oil ring groove 14. The boss portions 6 are opposed to each other in a first diametrical direction of the piston. In each boss portion 6, a piston-pin hole 16 is formed. A piston-pin (not shown) is coupled with the piston so that the piston is rotatable about an axis of the piston-pin, namely, an axis of the piston-pin hole 16. The piston-pin has opposite ends each of which is received in the piston-pin hole of each boss portion 6. The pair of skirt portions 8 are opposed to each other in a second diametrical direction of the piston which is perpendicular to the first diametrical direction of the piston. The skirt portions 8 keep a piston attitude and receive a thrust/counter-thrust force from a cylinder bore 20. Since the piston 2 slidably contacts the cylinder bore 20 only at the skirt portions 8, the thrust/counter-thrust force is received only by the skirt portions 8.

Each skirt portion 8 is configured so as to satisfy the following dimensional relationships:

$$0.4 \leqq S/(D * L) \leqq 0.55, \quad (1)$$

$$L/ \leqq 0.45, \quad (2)$$

and (3) a lower end of the skirt portion 8 extends lower than a lowermost portion of the piston-pin hole 16; where, L is a length of the skirt portion 8, D is a diameter of the cylinder bore 20 into which the piston 2 is inserted, and S is an area of an image which the skirt portion 8 forms on a vertical plane parallel to the first diametrical direction of the piston (for example, a plane including a longitudinal axis of the piston and an axis of the piston-pin) when projected onto the plane. In this instance, a width of the area S is W, and hatched portions in FIGS. 1–3 correspond to the area S.

Regarding the above-described dimensional relationships (1) and (2), the following relationships are more preferable:

$$0.45 \leqq S/(D * L) \leqq 0.5, \quad (1)$$

and $$L/D \leqq 0.4. \quad (2)$$

It is presumed that the friction between the piston and the cylinder bore is almost determined by a product of the projected area S of the skirt portion 8 and a force acting between the skirt portion 8 and the cylinder bore in the thrust/counter-thrust direction. Among these factors, a relationship between the projected area S of the skirt portion and the frictional resistance (friction loss) of the piston was analyzed in tests. Tests were conducted under the condition that the engine rotation was kept in the range of 1,000–3,000 rpm and the throttle was fully opened. To see a regular relationship independent of piston sizes, the test results were arranged using a parameter, S/(D * L), namely, a value obtained by dividing the projected area S of the piston by a projected area (D * L) of a corresponding full skirt of the piston. The broken line (Piston A) in FIG. 5 shows the test results. In FIG. 5, an average friction effective pressure is used for expressing the piston friction. Apparently from FIG. 5, the characteristic curve is upwardly concave, and the piston friction is small when the value, S/(D * L) is in the range of 0.4–0.55, and is near a minimum when the value, S/(D * L) is in the range of 0.45–0.5. A similar tendency is seen even if the piston size is varied.

It is presumed that the piston friction increases in the range where the value S/(D * L) is greater than 0.55 because the shear force of the oil film increases when the skirt portion area is large. It is presumed that the piston friction increases in the range where the value S/(D * L) is smaller than 0.4 because an oil film breakage is caused which increases a boundary lubrication region, despite a decrease in the skirt portion area. For these reasons, according to the invention, the value, S/(D * L) is settled in the range of 0.4–0.55, and more preferably, in the range of 0.45–0.5. For reference, the value S/(D * L) of the conventional piston is nearly 0.6. This means that the skirt portion 8 of the piston according to the invention is decreased in dimension compared with that of the conventional piston in L or W, or in both L and W.

Following only the above-described relationship (1) would allow the length of the piston skirt portion to be freely changed and, in some cases, could cause a case where the piston cannot bear a thrust/counter-thrust force. The above-described relationships (2) and (3) can prevent such a case from being caused. More particularly, suppose the relationship of W=0.5 * D is settled in the piston of FIG. 1, and the following equation will hold:

$$S/(D * L) = (L * 0.5, * D)/(D * L) = 0.5.$$

This means that even if L is freely varied keeping W equal to 0.5 * D, the relationship (1) is satisfied. However, if L is varied to be too great, the piston weight and therefore the piston inertia will be too great and the advantage of lightening the piston will be lost. Contrarily, if L is varied to be too small, piston inclination about the axis of the piston-pin will be too serious and the piston pressure will be locally too large, which will increase the piston friction. The relationships (2), (2)' and (3) define upper and lower limitations for the dimension, L. More particularly, the relationship that the value, L/D is equal to or smaller than 0.45 corresponds to a condition wherein the lower end of the skirt portion 8 is located lower than the lower end of the boss portion 6, and the relationship that the value, L/D is equal to or smaller than 0.4 corresponds to a condition wherein the lower end of the skirt portion 8 is located at substantially the same level as the lower end of the boss portion 6. These conditions decrease the length of the skirt portion compared with that of the conventional piston to thereby lighten the piston and for maintaining the piston attitude to thereby prevent the piston pressure from increasing. The relationship (3) is a condition for keeping a portion of the projected area located above the piston-pin hole axis greater than a portion of the projected area located below the piston-pin hole axis (in this connection, keep in mind that the upper end of the piston-pin hole is located at substantially the same level as the upper end of the skirt portion), to thereby maintain a stable piston attitude and to prevent the thrust/counter-thrust force from being increased.

Next, structures specific to each embodiment of the invention will be explained.

With the first embodiment, as illustrated in FIG. 1, the width W of the skirt portion 8 is constant throughout the entire length (height) of the skirt portion. This enables easy manufacture of the skirt portion compared with a case in which the width of the skirt portion is varied. For reference, in FIG. 1, D is 86 mm, the piston-pin diameter is 20 mm, and the value, S/(D * L) is 0.48.

Figure 2:
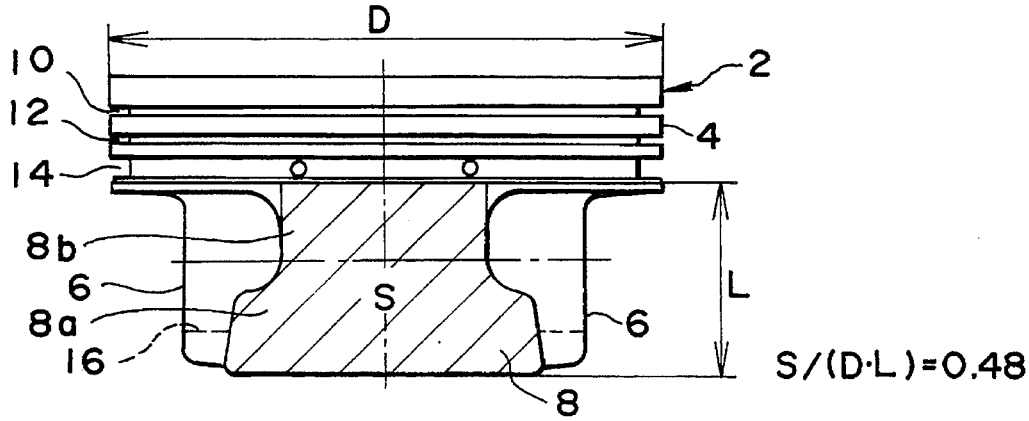
FIG. 2 is an elevational view of a piston for an internal combustion engine in accordance with a second embodiment of the invention.

With the second embodiment, as illustrated in FIG. 2, the skirt portion 8 has an upper portion **8*a* reduced in width and a lower portion 8*b* enlarged in width. Since the skirt portion 8 has a large area at the lower portion 8*b*, the piston 2 can effectively maintain a stable attitude. For reference, in FIG. 2**, D is 86 mm, the piston-pin diameter is 20 mm, and the value, S/(D * L) is 0.48.

Figure 3:
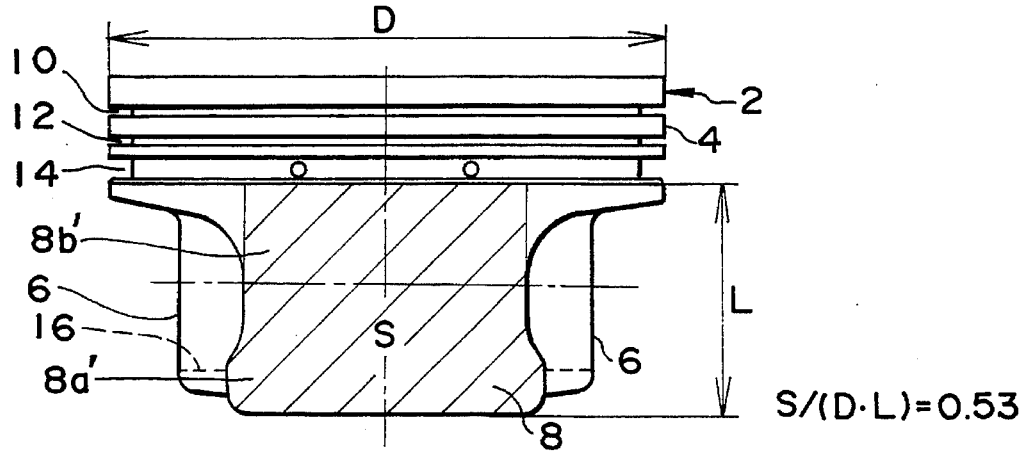
FIG. 3 is an elevational view of a piston for an internal combustion engine in accordance with a third embodiment of the invention.

With the third embodiment, as illustrated in FIG. 3, the upper portion **8*a*' of the skirt portion 8 is increased in width compared with that of the second embodiment, though the upper portion 8*a*' of the skirt portion 8 is smaller in width than the lower portion 8*b*' of the skirt portion in the third embodiment. The radius of a portion connecting the upper portion 8*a*' and the lower portion 8*b*' is larger than that of the second embodiment. For reference, in FIG. 3**, D is 86 mm, the piston-pin diameter is 20 mm, and the value, S/(D * L) is 0.53.

Figure 4:
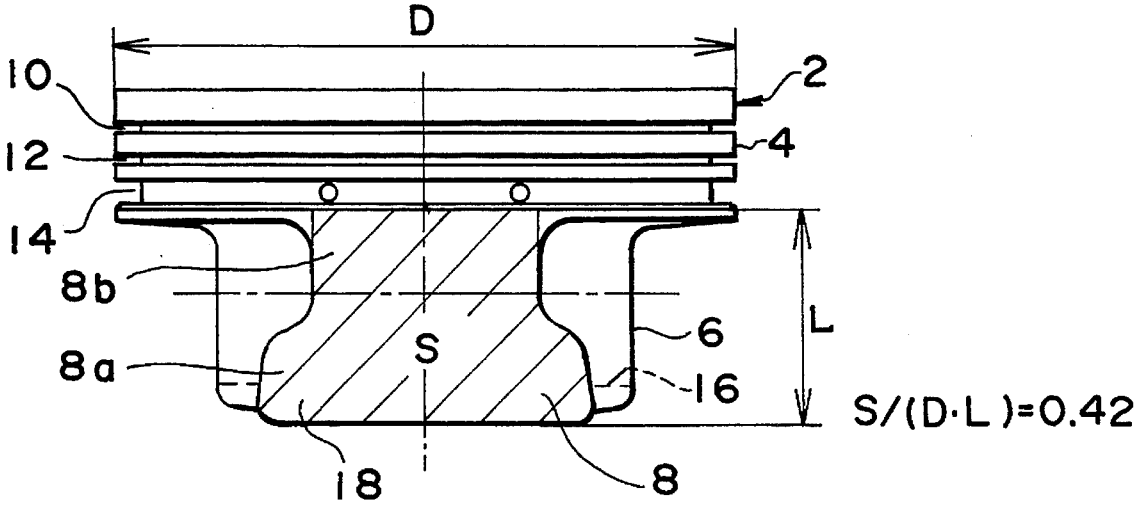
FIG. 4 is an elevational view of a piston for an internal combustion engine in accordance with a fourth embodiment of the invention.
Figure 5:
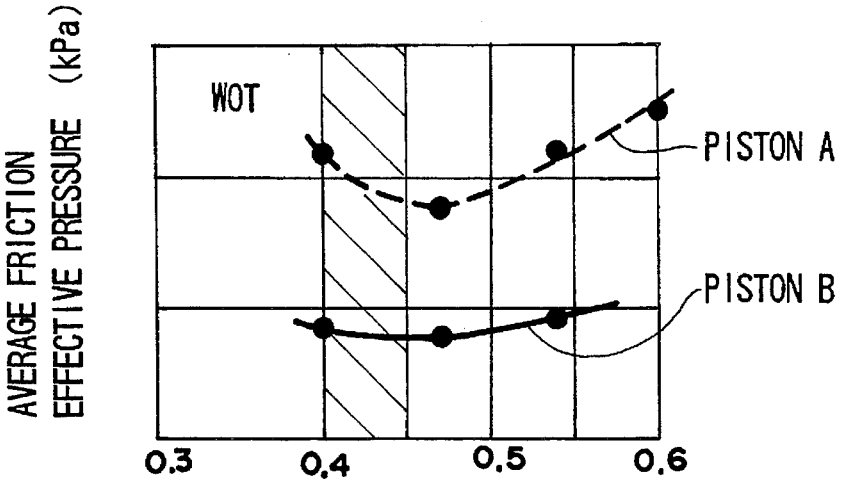
FIG. 5 is a graphical representation of an average friction-effective pressure versus value, S/(D * L) characteristic.

With the fourth embodiment which is shown in FIG. 4, for reference, D is 86 mm, the piston-pin diameter is 20 mm, and the value, S/(D * L) is 0.42, namely, lower than the preferable limit 0.45. In such a condition, it is preferable to coat a solid lubricant 18 (for example, molybdenum disulfide) on an outside surface of the skirt portion 8 (the hatched portion in FIG. 4). Though the value, S/(D * L) is less than 0.45, it is greater than 0.4 and is included in the range of the invention. The piston pressure is larger than that of a piston having a value S/(D * L) greater than 0.45. Thus, it is preferable to provide a coating of solid lubricant to prevent piston scuffing even if an oil film breakage is caused. Of course, a solid lubricant may be coated on the outside surface of the piston skirt portion even in the case where the value S/(D * L) is greater than 0.45. By coating the skirt portion with a solid lubricant, the piston friction characteristic is improved as shown in FIG. 5 by the full line (Piston B).

Next, reduction of the piston friction in accordance with the invention will be explained. Since the value S/(D * L) of the piston skirt portion is selected in the range of 0.4–0.55, not only the length but also the width of the skirt portion 8 is taken into account so that the piston friction is optimally decreased. Since the value S/(D * L) of a typical conventional piston is about 0.6 and the value S/(D * L) of the piston of Patent Publication SHO 61-58954 is much smaller than 0.4, the piston friction of these conventional pistons is greater than that of the piston according to the invention, which will be easily understood from FIG. 4.

Further, if the piston skirt portion satisfies the above-discussed relationships (2) and (3) also, the piston attitude will be kept stable and a local pressure increase will be effectively prevented. For reference, the value, L/D of the typical conventional piston is greater than 0.45, and in the piston of Patent Publication SHO 61-58954 the lower end of the piston skirt is located above the lowermost portion of the piston-pin hole. Therefore, those pistons are outside the above-discussed relationships (2) and (3).

With the piston according to the invention, since the value, S/(D * L) is selected in the range 0.4 to 0.55, the piston friction with the cylinder bore is decreased. Further, down-sizing and lightening of the piston is possible.

Although only four embodiments of the invention have been described in detail above, it will be appreciated by those skilled in the art that various modifications and alterations can be made to the particular embodiments shown without materially departing from the novel teachings and advantages of the present invention. Accordingly, it is to be understood that all such modifications and alterations are included within the spirit and scope of the present invention as defined by the following claims.

What is claimed is:

1. A piston for an internal combustion engine comprising:

a top portion;

a pair of boss portions opposed to each other in a first diametrical direction of the piston, each of the boss portions being integrally connected to the top portion from a lower side of the top portion and having a piston-pin hole formed therein; and a pair of skirt portions opposed to each other in a second diametrical direction of the piston perpendicular to the first diametrical direction of the piston, each of the skirt portions being integrally connected to the top portion from the lower side of the top portion, wherein each skirt portion is configured so as to satisfy the following dimensional relationship:

$$0.4 \leqq S/(D \cdot L) \leqq 0.55$$

where, L is a length of said each skirt portion, D is a diameter of a cylinder bore into which said piston is inserted, and S is an area of an image which each skirt portion forms when projected onto a vertical plane parallel to the first diametrical direction of the piston and wherein each skirt portion has an upper portion and a lower portion, and wherein the lower portion has a greater width than the upper portion.

2. A piston for an internal combustion engine comprising:

a top portion;

a pair of boss portions opposed to each other in a first diametrical direction of the piston, each of the boss portions being integrally connected to the top portion from a lower side of the top portion and having a piston-pin hole formed therein; and a pair of skirt portions opposed to each other in a second diametrical direction of the piston perpendicular to the first diametrical direction of the piston, each of the skirt portions being integrally connected to the top portion from the lower side of the top portion, wherein each skirt portion is configured so as to satisfy the following dimensional relationship:

$$0.45 \leqq S/(D \cdot L) \leqq 0.5$$

where, L is a length of said each skirt portion, D is a diameter of a cylinder bore into which said piston is inserted, and S is an area of an image which each skirt portion forms when projected onto a vertical plane parallel to the first diametrical direction of the piston.

3. A piston for an internal combustion engine comprising:

a top portion;

a pair of boss portions opposed to each other in a first diametrical direction of the piston, each of the boss portions being integrally connected to the top portion from a lower side of the top portion and having a piston-pin hole formed therein; and a pair of skirt portions opposed to each other in a second diametrical direction of the piston perpendicular to the first diametrical direction of the pistons each of the skirt portions being integrally connected to the top portion from the lower side of the top portion, wherein each skirt portion is configured so as to satisfy the following dimensional relationship:

$$0.4 \leqq S/(D \cdot L) \leqq 0.55$$

where, L is a length os said each skirt portion, D is a diameter of a cylinder bore into which said piston is inserted, and S is an area of an image which each skirt portion forms when projected onto a vertical plane parallel to the first diametrical direction of the piston and wherein each skirt portion has a constant width over an entire length thereof.

4. A piston according to claim 1 or 2, wherein each skirt portion is configured to further satisfy the following dimensional relationship:

$$L/D \leqq 0.45.$$

5. A piston according to claim 1 or 2, wherein each skirt portion has a lower end located lower than a lowermost portion of the piston-pin hole.

6. A piston according to claim 3, wherein the following relationship holds:

$$0.45 \leqq S/(D * L) \leqq 0.5.$$

7. A piston according to claims 1 or 2, wherein the following relationship holds:

$L/D \leqq 0.4$.

8. A piston according to claim 1 or 2, wherein each skirt portion has a constant width over an entire length thereof.

9. A piston according to claim 3, wherein each skirt portion has an upper portion and a lower portion, and wherein the lower portion has a greater width than the upper portion.

10. A piston according to claim 1 or 2, wherein each skirt portion has a solid lubricant coating layer formed on an outside surface thereof.

* * * * *

UNITED STATES PATENT AND TRADEMARK OFFICE

CERTIFICATE OF CORRECTION

PATENT NO. : 5,487,364
DATED : January 30, 1996
INVENTOR(S) : Masashi Takeda, et. al.

It is certified that error appears in the above-indentified patent and that said Letters Patent is hereby corrected as shown below:

| Column | Line | |
|---|---|---|
| 3 | 13 | Change "$L/\leq 0.45$," to --$L/D\leq 0.45$,--. |
| 6 | 39 | Change "pistons" to -- piston, --. |
| 6 | 53 | Change "1 or 2" to --1, 2 or 3--. |
| 6 | 59 | Change "1 or 2" to --1, 2 or 3--. |
| 6 | 66 | Change "1 or 2" to --1, 2 or 3--. |
| 8 | 3 | Change "1 or 2" to --1, 2 or 3--. |

Signed and Sealed this
Thirtieth Day of July, 1996

*Attest:*

*Attesting Officer*

BRUCE LEHMAN

*Commissioner of Patents and Trademarks*